US005799364A

United States Patent [19]

Foisy et al.

[11] Patent Number: 5,799,364

[45] Date of Patent: Sep. 1, 1998

[54] NOZZLE ADAPTER

[75] Inventors: Paul K. Foisy, Cleveland; Michael F. Wright, Cuyahoga Falls, both of Ohio

[73] Assignee: Royal Appliance Mfg. Co., Cleveland, Ohio

[21] Appl. No.: 575,471

[22] Filed: Dec. 20, 1995

[51] Int. Cl.[6] ..... A47L 5/32

[52] U.S. Cl. ..... 15/338; 15/344

[58] Field of Search ..... 15/338

[56] References Cited

U.S. PATENT DOCUMENTS 5,092,015 3/1992 Kosten et al. .

5,307,537 5/1994 Essex et al. .

*Primary Examiner*—Chris K. Moore

[57] ABSTRACT

The present invention is directed to a nozzle adapter for a vacuum cleaner. A plenum chamber housing is adapted for engaging receipt on a vacuum cleaner nozzle. An inlet housing extends from the plenum chamber housing. A slide surface is situated on the inlet housing and is suited for receipt of the slide member thereon. The slide member includes locking tabs and laterally extending biasing means which operatively cooperates with the plenum chamber housing.

13 Claims, 3 Drawing Sheets

NOZZLE ADAPTER

BACKGROUND OF THE INVENTION

The present invention pertains to the art of vacuum cleaners, and more particularly to vacuum cleaners that can be selectively modified by way of nozzle attachments or cleaning tools. The invention is particularly applicable to a nozzle adapter that is readily useable in conjunction with a hand held vacuum cleaner such as a Dirt Devil® electrical hand held vacuum cleaner. The nozzle adapter provides a connecting junction between a hand-held vacuum cleaner and its accessory cleaning tools.

In the past, whenever it became desirable to use accessory tools in conjunction with a hand held vacuum cleaner such as the Dirt Devil® hand-held vacuum cleaner, it was necessary to disengage the brush roller belt. Because the belt is stiff and sized to provide a tight fit around the roller, it can be difficult and inconvenient to replace without an appropriate tool. Even with the aid of a tool, replacement of the belt can be difficult. A nozzle adapter circumvents the need for removing and replacing the brush roller belt.

Nozzle adapters for hand held vacuum cleaners have been known in the art. One such adapter is disclosed in U.S. Pat. No. 5,307,537 owned by The Hoover Company. The adapter disclosed in that patent requires a user to physically deflect the walls of the converter body and tabs in order to disengage the adapter from the cleaner. The deflection occurs when a suitable force is applied to a fulcrum point located on the converter body. Such method of disengagement is undesirable. The deflection that occurs upon applying the required force is very slight, thus making it difficult for a user to know when the tabs have disengaged from the nozzle of the cleaner. As a result, a user often applies a greater force than necessary to disengage the adapter.

Another adapter known in the art is disclosed in U.S. Pat. No. 5,092,015 owned by Black & Decker Inc. The adapter shown in that patent uses a spring to move the tabs and gasket to allow the adapter to be removed from the cleaner. The number of parts needed and the assembly steps required for this adapter are not sufficiently economical.

The present invention contemplates a new and improved nozzle adapter which overcomes all of the above problems and others and provides for a nozzle adapter which is economically manufactured and simple for a user to operate, particularly with respect to engaging and disengaging the adapter from the vacuum cleaner unit.

BRIEF DESCRIPTION OF THE INVENTION

In accordance with the present invention, there is provided a nozzle adapter for a vacuum cleaner.

In accordance with a more limited aspect of the invention, a nozzle adapter assembly comprises a converter body and a slide member. The converter body includes a plenum chamber housing and an inlet chamber housing. The plenum chamber housing is formed or defined by upwardly extending front and rear walls joined together by flared side walls. The walls terminate in an outwardly extending lip adapted for engaging a vacuum cleaner nozzle housing. The inlet chamber housing includes a slide surface on an exterior portion thereof. The slide surface has a pair of guide rails extending therefrom. The slide member is received on the slide surface. A pair of L-shaped guides extending from the slide member track the guide rails on the inlet chamber housing. Laterally extending biasing means extend from the slide member and communicate with the front wall of the plenum chamber housing. A locking tab, also part of the slide member, secures the nozzle adapter to the vacuum cleaner nozzle.

The nozzle adapter is mounted to a vacuum cleaner by sliding the slide member along the inlet housing slide surface to temporarily position the locking tabs over the plenum chamber. An engagement tab which extends from the plenum chamber housing is placed between a vacuum cleaner nozzle guard and the vacuum cleaner nozzle. The locking tabs are then engaged between the nozzle guard and the vacuum cleaner housing. The locking tabs are biased against the vacuum cleaner housing to lock the adapter in place.

A principal advantage of the invention is that it is economically and easily assembled. Two molded parts (i.e., the slide member and the body which is made up of the inlet housing and the plenum chamber housing) are assembled together by hand with the application of a small force, resulting in relatively low manufacturing and assembly expenses.

Another advantage of the present invention is that it is relatively simple for a user to understand and operate. The nozzle adapter is shaped like the nozzle of a hand held vacuum cleaner. A user can readily join or match the adapter to the vacuum cleaner suction nozzle and lock it in place in a quick motion. The steps are reversed to remove the adapter from the vacuum cleaner.

Still other advantages and benefits of the invention will become apparent to those skilled in the art upon a reading and understanding of the following detailed description.

BRIEF DESCRIPTION OF DRAWINGS

The invention may take physical form in certain parts and arrangements of parts, a preferred embodiment of which will be described in detail in this specification and illustrated in the accompanying drawings which form a part hereof.

DETAILED DESCRIPTION OF THE PREFERRED EMBODIMENT

Figure 1:
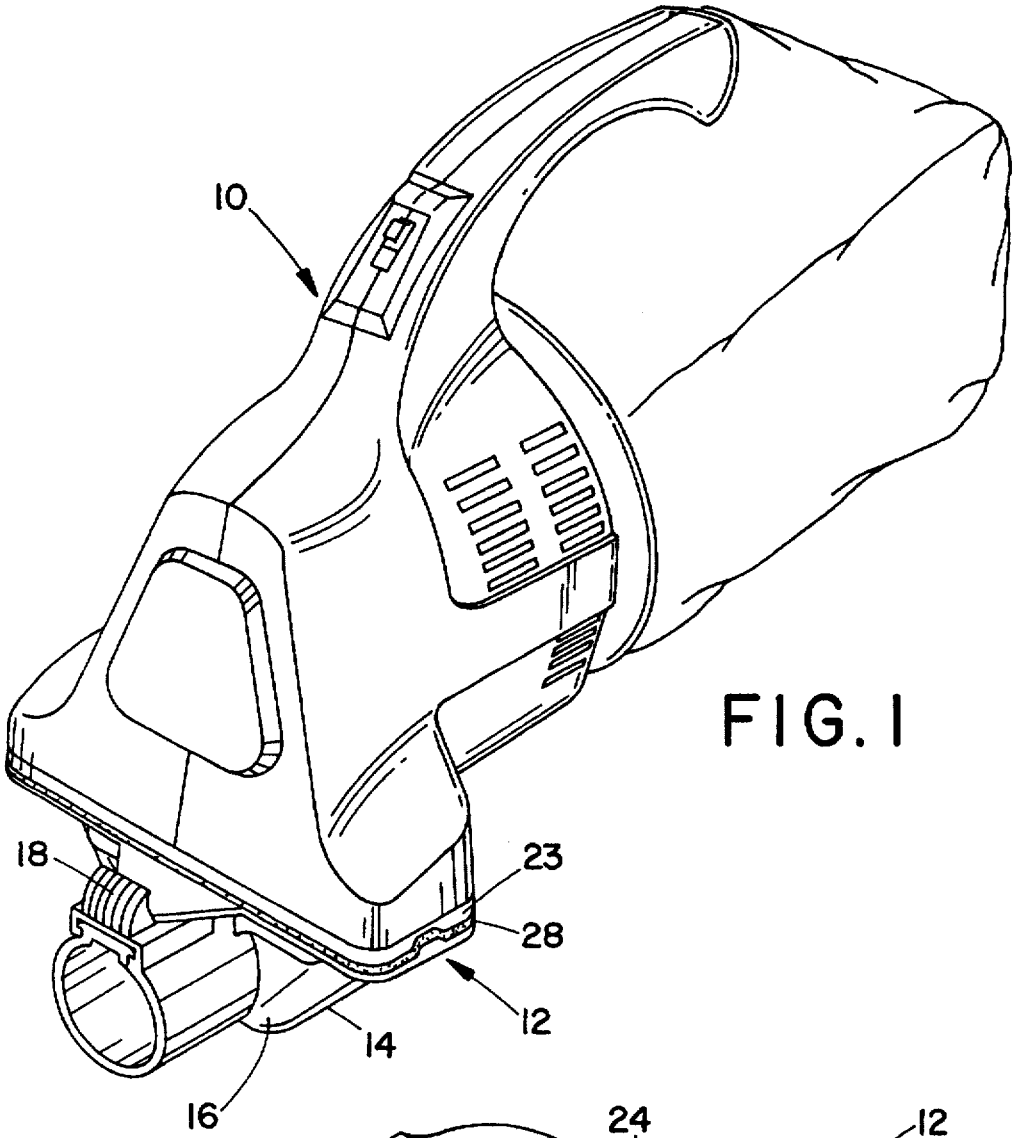
FIG. 1 is a perspective view of a nozzle adapter in accordance with the present invention. It is shown as used in its environment, mounted to a hand-held vacuum cleaner.

Referring now to the drawings wherein the showings are for purposes of illustrating the preferred embodiment of the invention only and not for purposes of limiting the same, the FIGURES show a nozzle adapter for use in conjunction with a hand-held vacuum cleaner. The purpose of the nozzle adapter is to permit accessory tools to be used with the hand-held vacuum cleaner without the need for disengaging the brush roller belt.

Figure 2:
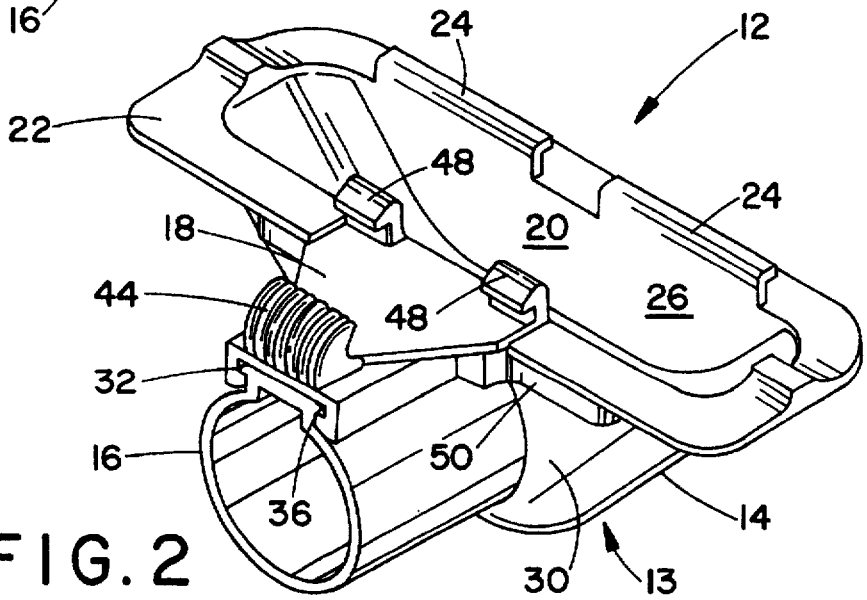
FIG. 2 is a perspective view of a nozzle adapter in accordance with the present invention.

With attention focused on FIG. 1, a hand-held vacuum cleaner 10 is shown with a nozzle adapter 12 mounted thereto. In that position, as shown in FIG. 1, the nozzle adapter is poised for receipt of accessory tools thereon. The accessory tools are not shown. A perspective view of the nozzle adapter 12 is displayed more readily in FIG. 2. The nozzle adapter is designed specifically to mount on an external wall of a hand-held vacuum cleaner suction nozzle such that a nozzle guard on the vacuum cleaner participates in securing the nozzle adapter in place.

Figure 3:
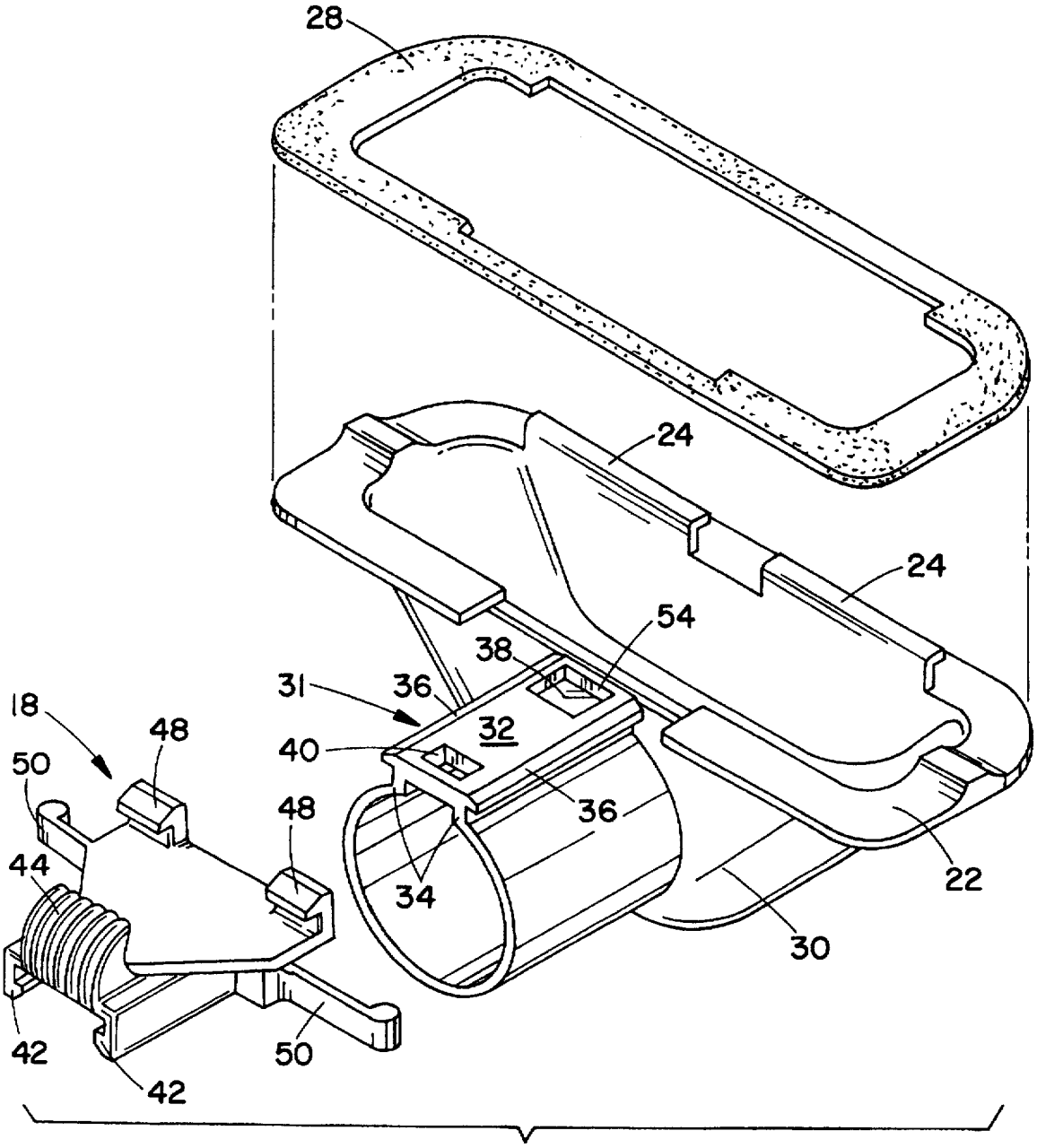
FIG. 3 is an exploded view of the nozzle adapter shown in FIG. 2.

The nozzle adapter includes a converter body 13, the body being comprised of a plenum chamber housing 14 and an inlet housing chamber 16. The nozzle adapter also includes a resilient slide member 18 which is shown in detail in FIG. 3. The plenum chamber housing 14 is defined by a plurality of walls which together define a plenum chamber 20. The walls extend upward and terminate in a peripheral flange of lip 22 which is substantially planar and discontinuous on an outer surface thereof, and configured to engage or laminarly meet with an outer wall of a vacuum cleaner suction nozzle or nozzle guard 23. A pair of engagement tabs 24 extend upward from the housing rear wall 26. The engagement tabs serve the purpose of holding or securing the plenum chamber housing to the suction nozzle of the hand-held vacuum cleaner. A gasket 28, shown more readily in FIG. 3, is configured to fit on the plenum chamber housing lip 22 to seal the laminar mating joint between the vacuum cleaner suction nozzle 23 and the nozzle adapter 12. The inlet housing or inlet connector 16 extends outwardly from a front wall 30 of the plenum housing chamber. The inlet housing or inlet connector means is designed to receive or connect an accessory tool such as a vacuum cleaner hose to the plenum chamber. Fluid flows through the inlet chamber, into the plenum chamber and through the vacuum cleaner suction nozzle during use of the vacuum cleaner with the nozzle adapter attached thereto. The rear wall 26 and front wall 30 of the plenum chamber housing are joined together by a pair of outwardly flared side walls.

The inlet connector housing 16 is substantially circular in configuration with the exception of an upper arc portion which is replaced by a raised member 31 that runs longitudinally along the length of the inlet housing 16. A slide surface 32 is positioned just above the inlet housing means on an exterior wall of the raised member. The raised member, which includes the slide surface, is molded with or joined to the inlet housing by two extender walls 34 which are directed upward from the circular connector housing. The slide surface runs longitudinally along the entire length of the inlet housing means. A pair of parallel and symmetrical rails or flange like runners 36 frame the slide surface and run along the respective sides thereof. The runners 36 are shown to extend outward in the plane of the slide, although it is fully within the scope of this invention for the runners to extend in another direction such as upward, downward or in any direction about the slide surface. A slide pocket or void 38 is defined within and by the slide surface 32. An opening 40 is defined in the connector on the raised member for the purpose of joining accessory tools thereto.

Slide member 18 is adapted for receipt on slide surface 32. The slide member includes a pair of downwardly extending L-shaped guides 42 which are adapted for mounting on rails 36. The guides comprise a groove which is slightly larger than the size of the rails 36 to permit ease of sliding movement back and forth along the rails 36. Slightly raised from the level of the guides is a handle or release tab 44 which a user may depress in order to mount the nozzle adapter to a vacuum cleaner nozzle or to dismount the nozzle adapter therefrom. A connecting table surface 46 extends form the handle 44 and is molded thereto. The molded table surface 46 terminates in two upwardly extending locking tabs 48 situated opposite the handle. A pair of laterally extending biasing means or leaf springs 50 extend outward from each of the slide assembly guides 42. The leaf springs are designed to communicate operatively with the front wall 30 of the plenum chamber housing.

Figure 4:
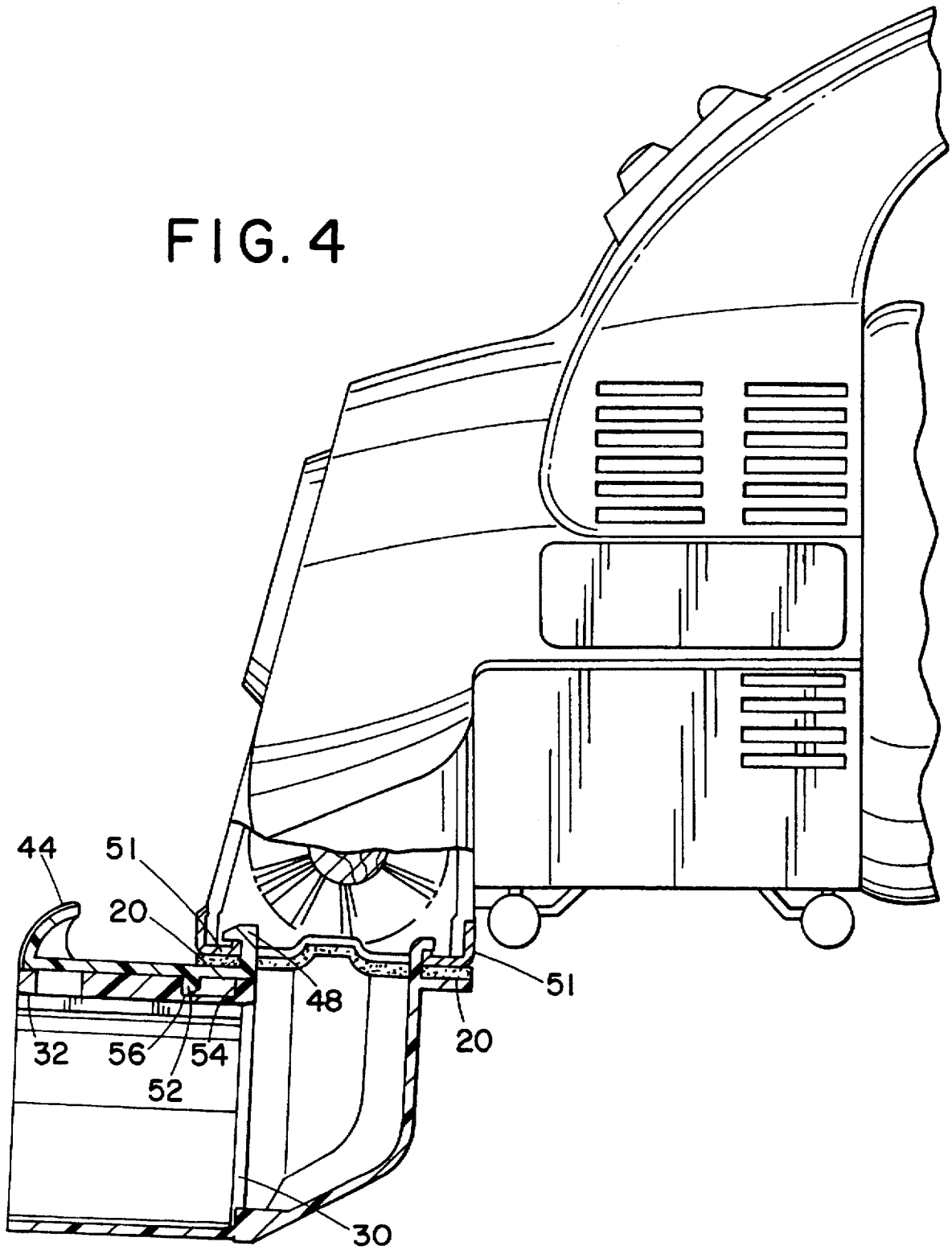
FIG. 4 is a side cross-sectional view of the nozzle adapter mounted to a hand-held vacuum cleaner.

Before the nozzle adapter can be mounted to a vacuum cleaner nozzle opening, the slide member 18 is in its rest or unloaded position. In this position, the biasing means 50 are not stressed and the locking tabs are in substantially the same plane as the front wall 30 of plenum chamber 20. This is evident in FIG. 4. A vertical portion 43 of the locking tabs effectively extends a portion of an interior surface of the front wall 30 of the plenum chamber.

In order to use the nozzle adapter and mount it to a vacuum cleaner, release tab 44 is depressed and the entire slide assembly moves forward, guided by rails 36, such that the vertical portion of each locking tab 48 slides beyond the plane of the front wall 30 of the plenum chamber to a position above the plenum chamber 20. The engagement tabs 24 are then placed above a vacuum cleaner nozzle guard 51 which comprises an external surface of the hand held vacuum cleaner nozzle. The nozzle guard is then sandwiched between the engagement tabs 24 and the top surface or lip 20 of the nozzle adapter plenum chamber housing. The front of the adapter is then brought up toward the nozzle until the locking tabs engage the vacuum cleaner nozzle. Here again, the nozzle guard 51 fits between locking tabs 48 and lip 20. The release tab 44 is released and the locking tabs become temporarily locked to the nozzle surface 23. The biasing means 50 are then slightly loaded. The shape of the locking tabs is such that they will cause the slide to move inward, thus deflecting the leaf springs without any other outside force. A stop tab 52 which extends downward from the planar connecting table 46 is in a cooperating arrangement with slide pocket 38. As the entire slide assembly moves forward to place the locking tabs over the plenum chamber, the stop tab reaches a back wall 54 of the slide pocket and this prevents the slide assembly from moving too far forward. Similarly, a front wall 56 of the slide pocket prevents the slide assembly from sliding off of the slide surface 32.

In order to disengage the adapter from a vacuum cleaner, the release tab 44 is depressed so that the entire slide is pushed forward until the leaf springs are fully compressed. The locking tabs disengage from the vacuum cleaner nozzle, and the adapter is removed from the nozzle by sliding the engaging tabs out from the nozzle guard 51 of the cleaner.

In order to assemble the adapter, the slide member 18 is placed at the back edge of the slide surface 32, located on the inlet housing 16 of the adapter body, in such a way that the guides 42 are mated with the underside of the rails 36. The slide is then forced along the rails until the stop tab rests in the slide pocket and the top surface of the slide is flush with the top of the adapter body. When the slide is in the unloaded position, there is no force or deflection on the leaf springs 50.

The present invention is advantageous in its ease of use and assembly. There is a range of movement of the slide that is limited in such a way that the disengagement point is easily seen and felt by a user. This provides a user with a sure signal that the adapter can be removed from the cleaner. Since the deflection in the biasing means is away from the locking tabs, the wear on them is greatly reduced, increasing their life. The assembly, as described above, is a simple two step process which only requires two parts, the slide member 18 and the converter body which comprises a combined inlet chamber and plenum chamber housing.

The invention has been described with reference to the preferred embodiment. Obviously, modifications and alterations will occur to others upon a reading and understanding of the specification. It is intended to include all such modifications and alterations insofar as they come within the scope of the appended claims or the equivalent thereof.

We claim:

1. A nozzle adapter for a vacuum cleaner, comprising:

a body comprising a plenum chamber housing adapted for engaging receipt on a vacuum cleaner nozzle, and an inlet housing extending from the plenum chamber housing adapted for receiving vacuum cleaner accessory tools;

a slide surface situated on said inlet housing; and a slide member received on said slide surface, the slide member including a locking tab and laterally extending biasing means for cooperating with an exterior wall of the plenum chamber housing to bias the locking tab against the vacuum cleaner housing.

2. A nozzle adapter for a vacuum cleaner, according to claim 1, wherein the plenum chamber housing includes an engaging tab adapted to be received on a vacuum cleaner nozzle.

3. A nozzle adapter for a vacuum cleaner, according to claim 1, wherein the plenum chamber housing defines a lip which substantially corresponds to a vacuum cleaner nozzle opening surface for engaging receipt thereon.

4. A nozzle adapter for a vacuum cleaner, according to claim 1, wherein a gasket is affixed to the plenum chamber housing lip to seal a laminar joint formed between the lip and the vacuum cleaner nozzle opening surface.

5. A nozzle adapter for a vacuum cleaner, according to claim 1, wherein the inlet housing defines a channel which is in open communication with the plenum chamber.

6. A nozzle adapter for a vacuum cleaner, according to claim 1, wherein the slide surface is situated longitudinally on the inlet housing, the slide surface defining a pair of longitudinal rails extending therefrom and used for guiding the slide member.

7. A nozzle adapter for a vacuum cleaner, according to claim 1, wherein the slide member includes a downwardly extending stop tab in cooperating communication with a void defined in the slide surface.

8. A nozzle adapter for a vacuum cleaner, comprising:

an adapter body defining a plenum chamber and having an inlet housing extending therefrom, the inlet housing including an exterior slide surface adapted for receipt of a slide member thereon, the slide member including tabs extending therefrom and adapted for locking the nozzle adapter to a vacuum cleaner nozzle, and a biasing means extending laterally from the slide member for cooperating with an exterior wall of the plenum chamber to bias said tabs against the vacuum cleaner nozzle.

9. A nozzle adapter assembly, comprising:

a converter body comprising a plenum chamber housing and an inlet chamber housing, the plenum chamber housing comprising upwardly extending front and rear walls joined together by flared side walls and terminating in an outwardly extending lip adapted for engaging a vacuum cleaner nozzle housing, the inlet chamber housing including a slide surface on an exterior portion thereof, the slide surface having a pair of guide rails extending therefrom; and a slide member received on said slide surface, the slide member having a pair of guides which track the guide rails on the inlet chamber housing, a locking tab for securing the nozzle adapter to a vacuum cleaner nozzle, and laterally extending biasing means for biasing said locking tab against the vacuum cleaner assembly.

10. A nozzle adapter assembly, according to claim 9, wherein an engagement tab extends from the rear wall of the plenum chamber housing and is adapted to be received by a vacuum cleaner nozzle.

11. A nozzle adapter assembly, according to claim 9, wherein a gasket is received on the lip which extends from the plenum chamber housing.

12. A nozzle adapter assembly, according to claim 9, wherein a slide pocket defined by said slide surface communicates with a stop tab extending from the slide member to limit the sliding motion of the slide member.

13. A method for mounting a nozzle adapter to a vacuum cleaner, comprising the steps of:

providing a nozzle adapter assembly comprising a plenum chamber housing, an inlet chamber housing and a slide member, the slide member having a locking tab extending therefrom;

sliding the slide member along a nozzle adapter inlet housing slide surface;

positioning the locking tab over a plenum chamber defined by the plenum chamber housing;

placing an engagement tab extending from the plenum chamber housing above a nozzle guard to sandwich the nozzle guard between the engagement tab and a lip extending from the plenum chamber housing;

engaging the locking tab above the nozzle guard to sandwich the nozzle guard between the locking tab and the plenum chamber housing lip;

stressing laterally extending biasing means against a plenum chamber housing wall; and biasing the locking tab against the vacuum cleaner housing.

* * * * *